US011002038B2

(12) United States Patent
McCarroll

(10) Patent No.: US 11,002,038 B2
(45) Date of Patent: May 11, 2021

(54) FENCE SAFETY AND ANTI-THEFT SYSTEM

(71) Applicant: Gary McCarroll, Lubbock, TX (US)

(72) Inventor: Gary McCarroll, Lubbock, TX (US)

( * ) Notice: Subject to any disclaimer, the term of this patent is extended or adjusted under 35 U.S.C. 154(b) by 656 days.

(21) Appl. No.: 15/798,386

(22) Filed: Oct. 30, 2017

(65) Prior Publication Data

US 2018/0119445 A1 May 3, 2018

Related U.S. Application Data

(60) Provisional application No. 62/414,351, filed on Oct. 28, 2016.

(51) Int. Cl.
*E04H 17/00* (2006.01)
*E04H 17/14* (2006.01)

(52) U.S. Cl.
CPC ..... *E04H 17/003* (2013.01); *E04H 17/143* (2013.01); *E04H 17/1447* (2021.01); *E04H 17/1452* (2021.01)

(58) Field of Classification Search
CPC . E04H 17/003; E04H 17/143; E04H 17/1434; E04H 2017/1452; E04H 17/1447; E04H 17/1452
USPC ..... 256/22, 19
See application file for complete search history.

(56) References Cited

U.S. PATENT DOCUMENTS 1,548,133 A 8/1925 Frost
2,145,172 A * 1/1939 Gustafson ..... E04H 17/1439 256/22
4,214,734 A 7/1980 Stafford
4,270,736 A 6/1981 Burch
5,421,557 A 6/1995 Vise
6,029,954 A 2/2000 Murdaca
6,637,728 B2 * 10/2003 Pettit ..... E04H 17/1421 256/19
6,672,569 B2 * 1/2004 Deeley ..... E04H 17/003 256/22
6,824,123 B2 11/2004 Larsen et al.
8,276,887 B2 * 10/2012 Mann ..... E04H 17/143 256/22
2005/0082518 A1 4/2005 Kunitz

FOREIGN PATENT DOCUMENTS

GB 1417891 A * 12/1975 ..... E04H 17/1434
GB 2094369 A * 9/1982 ..... E04H 17/1434

* cited by examiner

*Primary Examiner* — Matthew R McMahon
(74) *Attorney, Agent, or Firm* — Shannon Warren

(57) ABSTRACT

Safety rail assemblies comprise horizontal beveled rails having a beveled face, a width, a height, a bottom, a back, and a bevel angle. The safety rail assemblies are configured to selectively attach to horizontal rails and pickets of one or more fence segments. The bottom of the safety rail assemblies attaches to a top of the horizontal rails. The back of the horizontal beveled rails attaches to the pickets. The bottom is a horizontal plane. The back is a vertical plane. The beveled face comprises the bevel angle and represents a face of the horizontal beveled rails being non-horizontal and non-vertical between the back and the bottom.

8 Claims, 16 Drawing Sheets

Filed By:

FENCE SAFETY AND ANTI-THEFT SYSTEM

CROSS-REFERENCE TO RELATED APPLICATIONS

This application claims benefit to U.S. Patent Application No. 62/414,351 filed on Oct. 28, 2016.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

Prior art known to the Applicant includes 5421557, 1548133, 4270736, 201520768405, 201520633522, DE19904036888, 86165341D, 201320121443, CN 201520073525, 201320017833, CN 200820104522, CN 201520768397, CN 98207230, CN 201020227937, U.S. Pat. Nos. 5,930,986, 6,824,123B2, 6,029,954A, US20050082518A1.

None of the known inventions and patents, taken either singularly or in combination, is seen to describe the instant disclosure as claimed.

BRIEF SUMMARY OF THE INVENTION

A safety rail assemblies for improving a one or more fence segments. Said safety rail assemblies comprising a beveled face, a width, a height, a bottom, a back, a bevel angle. Said safety rail assemblies configured to selectively attach to a horizontal rails and a pickets of said one or more fence segments. Said bottom of said safety rail assemblies attaches to a top of said horizontal rails. Said back of a horizontal beveled rails attaches to said pickets. Said bottom is a horizontal plane. Said back is a vertical plane. A beveled face comprises said bevel angle and represents a face of said horizontal beveled rails being non-horizontal and non-vertical between said back and said bottom.

A safety rail assemblies for improving a one or more fence segments. Said safety rail assemblies comprising a beveled face, a width, a height, a bottom, a back, a bevel angle. Said safety rail assemblies configured to selectively attach to a horizontal rails and a pickets of said one or more fence segments. Said bottom of said safety rail assemblies attaches to a top of said horizontal rails. Said back of a horizontal beveled rails attaches to said pickets. Said bottom is a horizontal plane. Said back is a vertical plane. A beveled face comprises said bevel angle and represents a face of said horizontal beveled rails being non-horizontal and non-vertical between said back and said bottom. Said safety rail assemblies is attached to said pickets with said beveled face facing upward to prevent easy climbing of said one or more fence segments. Said safety rail assemblies comprise a one or more segments. Each among said one or more segments are configured to selectively break apart into separate and similar parts. Said one or more segments comprise at least a first segment and a second segment. Said one or more segments can each comprise a slot at a second end, a tab at a back side, a one or more horizontal apertures from said beveled face to said back side, and a one or more vertical apertures from said beveled face to a bottom side. Said slot of said first segment selectively mates with said tab of said second segment. Attaching said one or more segments to said one or more fence segments comprise aligning a portion of said bottom side of said one or more segments with said horizontal rails and a portion of said back side of said one or more segments with a portion of said pickets, attaching said one or more segments to said horizontal rails and said pickets, and attaching one or more among said horizontal beveled rails to one another with said slot and said tab.

DETAILED DESCRIPTION OF THE INVENTION

Figure 1:
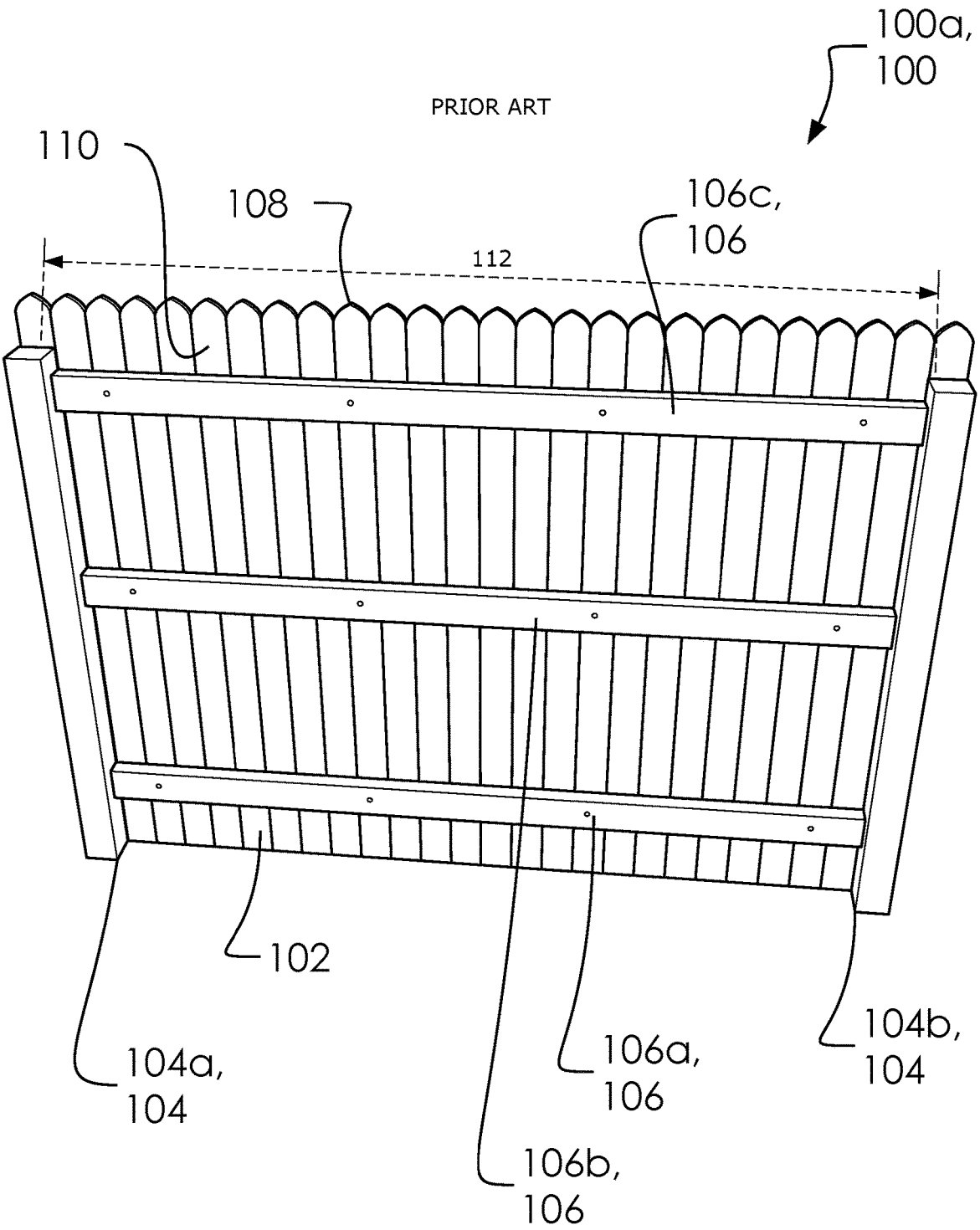
FIG. 1 illustrates a perspective overview view of a first fence segment 100*a*, comprising prior art.

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

These parts are illustrated in the figures and discussed below:

a one or more fence segments 100
a first fence segment 100*a*
a second fence segment 100*b*
a third fence segment 100*c*
a pickets 102
a posts 104
a first post 104*a*
a second post 104*b*
a horizontal rails 106
a first horizontal rail 106*a*
a second horizontal rail 106*b*
a third horizontal rail 106*c*
a picket spikes 108
a back side 110
a span 112
an omni-directional fence assembly 200
a backyard 202
an alternating-directional fence assembly 300
a front side 302
an exploded view 500*a*
an assembled view 500*b*
a safety rail assemblies 502
a first safety rail assembly 502*a*
a second safety rail assembly 502*b*
a third safety rail assembly 502*c*
a horizontal beveled rails 504
a first horizontal beveled rail 504*a*
a second horizontal beveled rail 504*b*
a third horizontal beveled rail 504*c*
a nails 506
a width 602
a one or more segments 604
a first segment 604*a*
a second segment 604*b*
a third segment 604*c*
a fourth segment 604*d*
a width 606
a beveled face 608
a first end 610
a second end 612
an extruded rail assembly 700
a wooden rail assembly 702
a hollow body 704
a height 802
a width 804
a height 806
a width 808
a bevel angle 810
a beveled face 812
a bottom 814
a back 816
a top 818
a bottom 820
a back 822
a front 824
a first unibody rail assembly 900
a beveled face 902
a first end 904*a*
a second end 904*b*
a front 906
a back 908
a bottom 910
a height 912
a lower height 914
a depth 916
a width 918
a bevel angle 920
a second unibody rail assembly 1000
a beveled face 1002
a first end 1004*a*
a second end 1004*b*
a front 1006
a back 1008
a bottom 1010
a height 1012
a lower height 1014
a depth 1016
a width 1018
a bevel angle 1020
an improved fence segment 1100
an alternative fence configuration 1200
a slot 1302
a tab 1304
a one or more vertical apertures 1306
a first vertical aperture 1306*a*
a second vertical aperture 1306*b*
a third vertical aperture 1306*c*
a fourth vertical aperture 1306*d*
a fifth vertical aperture 1306*e*
a sixth vertical aperture 1306*f*
a one or more horizontal apertures 1308
a first horizontal aperture 1308*a*
a second horizontal aperture 1308*b*
a back side 1312
a bottom side 1314
a first end 1316
a second end 1318
a width 1400
a first end 1500
a second end 1502
a cut off tab 1504
a one or more joints 1506 a first joint 1506*a*
a second joint 1506*b*
a third joint 1506*c*
an empty slot 1508

FIG. 1 illustrates a perspective overview view of a first fence segment 100*a*, comprising prior art.

In one embodiment, said one or more fence segments 100 can comprise said first fence segment 100*a*, said second fence segment 100*b*, said third fence segment 100*c*, said pickets 102, said posts 104, said horizontal rails 106, said back side 110 and said span 112.

In one embodiment, said pickets 102 can comprise said picket spikes 108.

In one embodiment, said posts 104 can comprise said first post 104*a*, said second post 104*b* and said span 112.

In one embodiment, said horizontal rails 106 can comprise said first horizontal rail 106*a*, said second horizontal rail 106*b* and said third horizontal rail 106*c*.

In one embodiment, said one or more fence segments 100 can comprise a set of pickets 102 arranged around a yard or other space, as is known in the art. Said one or more fence segments 100 can support said pickets 102 with said posts 104 and said horizontal rails 106.

Said horizontal rails 106 can be spaced across said back side 110, as is known in the art.

Said picket spikes 108 can be aligned on a top edge of said one or more fence segments 100 so as to discourage climbing and jumping over said one or more fence segments 100, as is known in the art.

Said posts 104 can be largely vertical members for supporting said one or more fence segments 100 and can be spaced along the span of said one or more fence segments 100. In one embodiment, said posts 104 are buried in a ground surface to ensure said one or more fence segments 100 is stable.

Figure 12:
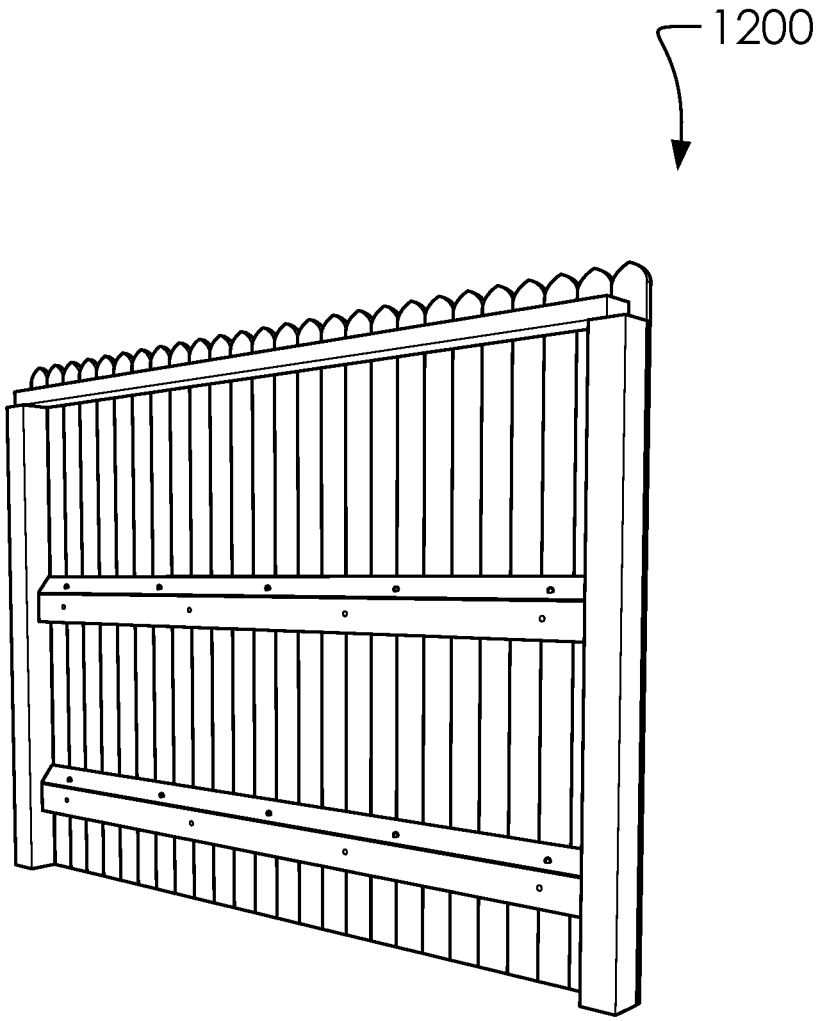
FIG. 12 illustrates a perspective overview view of an alternative fence configuration 1200.

Different configurations of said one or more fence segments 100 are well-known, where some include more or less of said horizontal rails 106 and/or said posts 104, others comprise a reconfiguration of said third horizontal rail 106*c* (as shown in FIG. 12), and still others with variations on shapes, spacing and heights of said pickets 102.

The current disclosure is seen as applying to a wide range of configurations of fences, and would be understood as having that luxury by one in the art.

Figure 2:
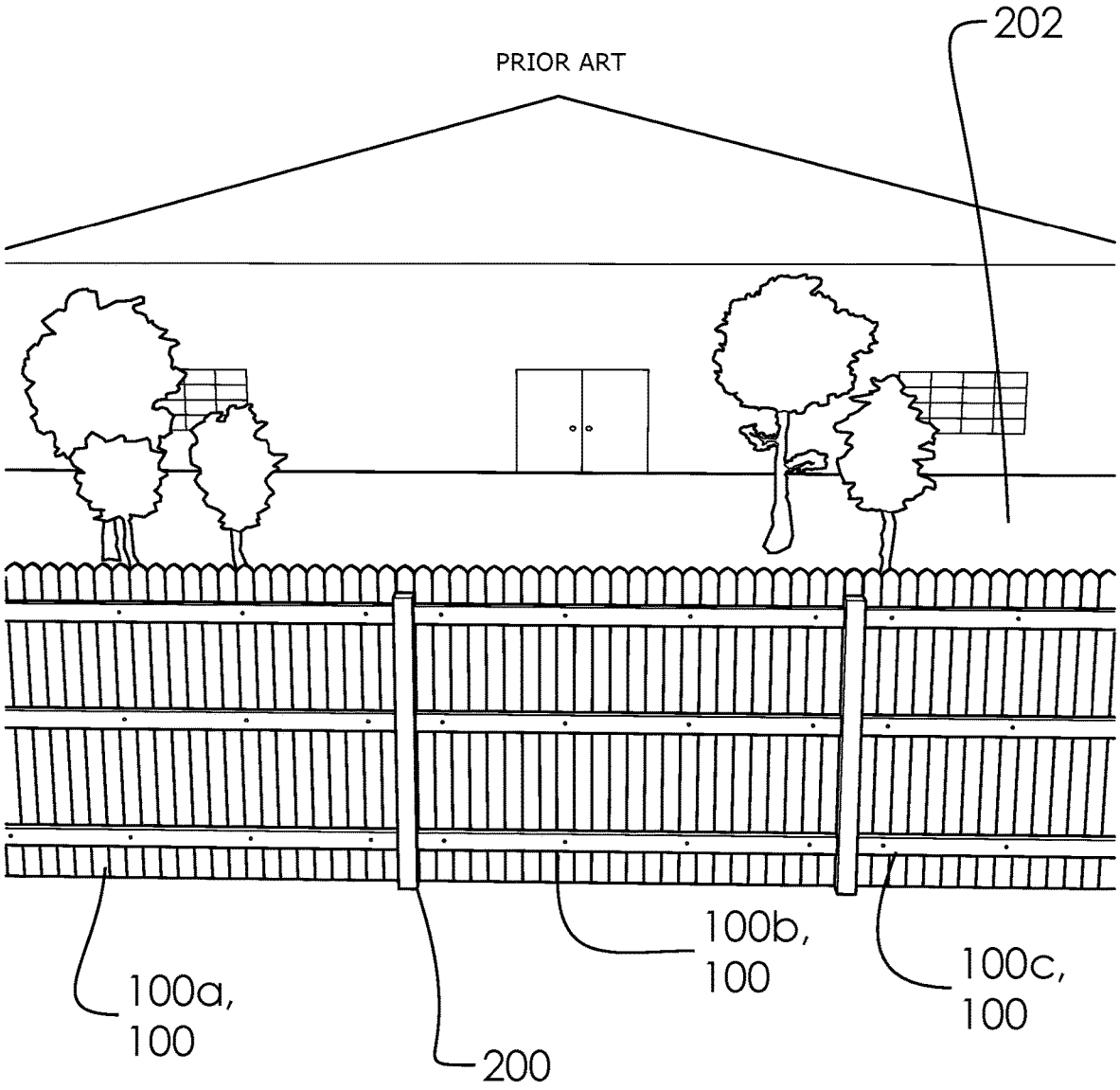
FIG. 2 illustrates a perspective overview view of an omni-directional fence assembly 200, comprising prior art.

FIG. 2 illustrates a perspective overview view of an omni-directional fence assembly 200, comprising prior art.

Here, it is shown that where said one or more fence segments 100 is arranged around said backyard 202, a trespasser will have the opportunity to scale said one or more fence segments 100 (or said omni-directional fence assembly 200, as shown) with ease because said horizontal rails 106 function like a ladder.

Said omni-directional fence assembly 200 can comprise a configuration of said one or more fence segments 100 with each facing the same way having said back side 110 facing an alley or space outside of said backyard 202.

Figure 3:
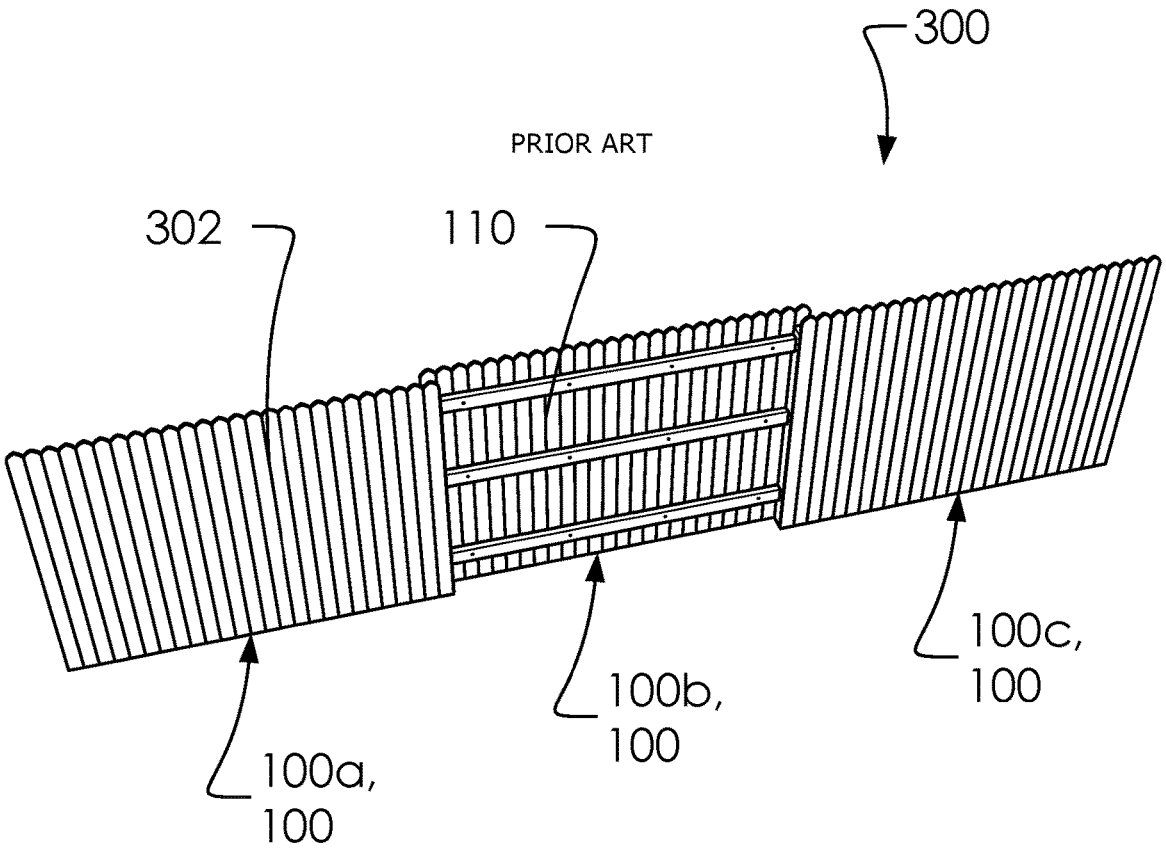
FIG. 3 illustrates a perspective overview view of an alternating-directional fence assembly 300, comprising prior art.

FIG. 3 illustrates a perspective overview view of an alternating-directional fence assembly 300, comprising prior art.

In one embodiment, said one or more fence segments 100 can comprise said alternating-directional fence assembly 300 and said front side 302.

Said alternating-directional fence assembly 300 can comprise said one or more fence segments 100 with each segment being alternated as to orientation. For example, in one embodiment, said first fence segment 100*a* can face a first direction, said second fence segment 100*b* an opposite direction, said third fence segment 100*c* the same as the first direction, and so on.

Note that, as illustrated, said front side 302 would be difficult to scale for lack of access to said horizontal rails 106. However, it might be said that said front side 302 is more pleasing to the eye, so one would understand why a builder might orient said one or more fence segments 100 as shown in FIG. 2, with said front side 302 facing said backyard 202.

Said alternating-directional fence assembly 300 is a common configuration along shared fence lines between houses so that all homes along said alternating-directional fence assembly 300 have alternating views of said picket spikes 108 and said front side 302.

Figure 4:
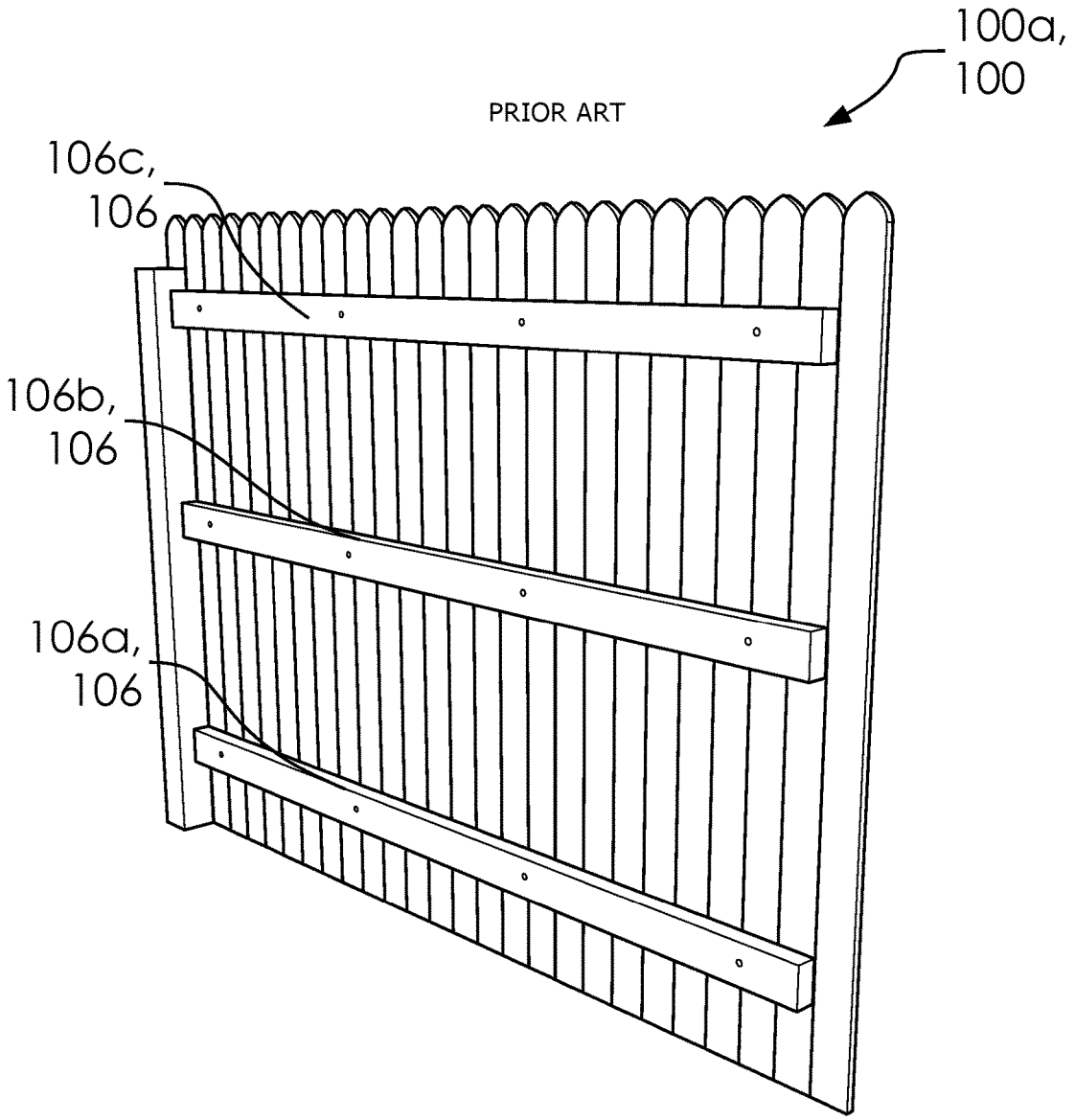
FIG. 4 illustrates a perspective first side view of a first fence segment 100*a* without said second post 104*b*, comprising prior art.

FIG. 4 illustrates a perspective first side view of a first fence segment 100*a* without said second post 104*b*, comprising prior art.

Here, said first fence segment 100*a* is shown without said second post 104*b* so as to highlight the shape and configuration of said horizontal rails 106.

Figure 5A:
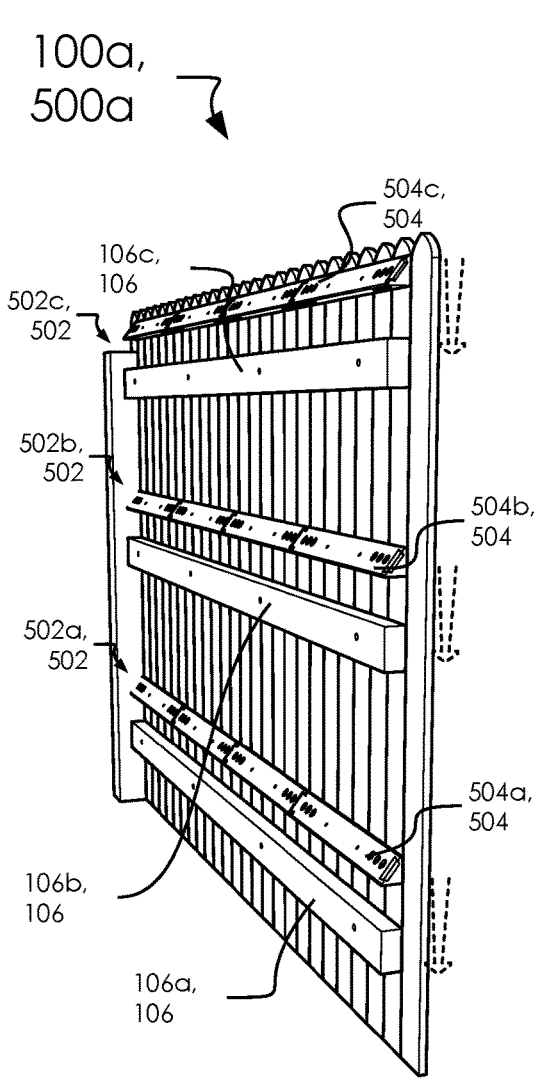
FIG. 5A illustrates a perspective first side view of a first fence segment 100*a* with said one or more safety rail assemblies 502 in said exploded view 500*a*.

FIG. 5A illustrates a perspective first side view of a first fence segment 100*a* with said one or more safety rail assemblies 502 in said exploded view 500*a*.

Figure 5B:
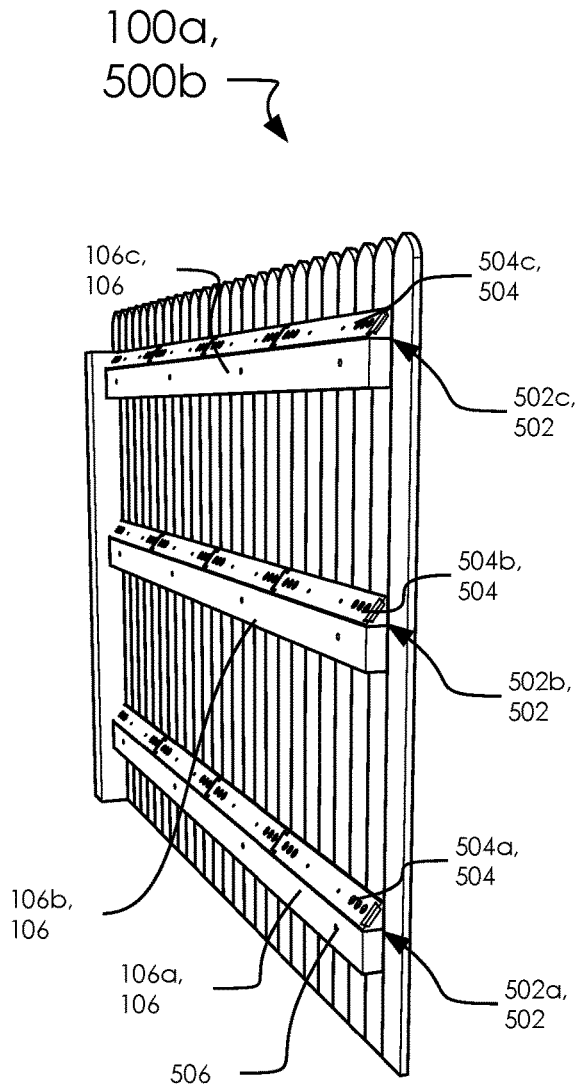
FIG. 5B illustrates a perspective first side view of a first fence segment 100*a* with said one or more safety rail assemblies 502 in said assembled view 500*b*.

FIG. 5B illustrates a perspective first side view of a first fence segment 100*a* with said one or more safety rail assemblies 502 in said assembled view 500*b*.

In one embodiment, said safety rail assemblies 502 can comprise said exploded view 500*a*, said assembled view 500*b*, said first safety rail assembly 502*a*, said second safety rail assembly 502*b*, said third safety rail assembly 502*c* and said nails 506.

In one embodiment, said first safety rail assembly 502*a* can comprise said first horizontal beveled rail 504*a*.

In one embodiment, said second safety rail assembly 502*b* can comprise said second horizontal beveled rail 504*b*.

In one embodiment, said third safety rail assembly 502*c* can comprise said third horizontal beveled rail 504*c*.

In one embodiment, said horizontal beveled rails 504 can comprise said first horizontal beveled rail 504*a*, said second horizontal beveled rail 504*b* and said third horizontal beveled rail 504*c*.

In one embodiment, said one or more fence segments 100 can comprise said nails 506.

Each among said safety rail assemblies 502 can be attached to or a part of said horizontal rails 106. Further each safety rail assemblies 502 can comprise said horizontal beveled rails 504.

Once assembled according to said assembled view 500*b*, said safety rail assemblies 502 can comprise a beveled face, as discussed below.

Said horizontal beveled rails 504 can comprise a great alternative to rebuilding a fence for a customer interested in improving an existing fence.

Figure 6A:
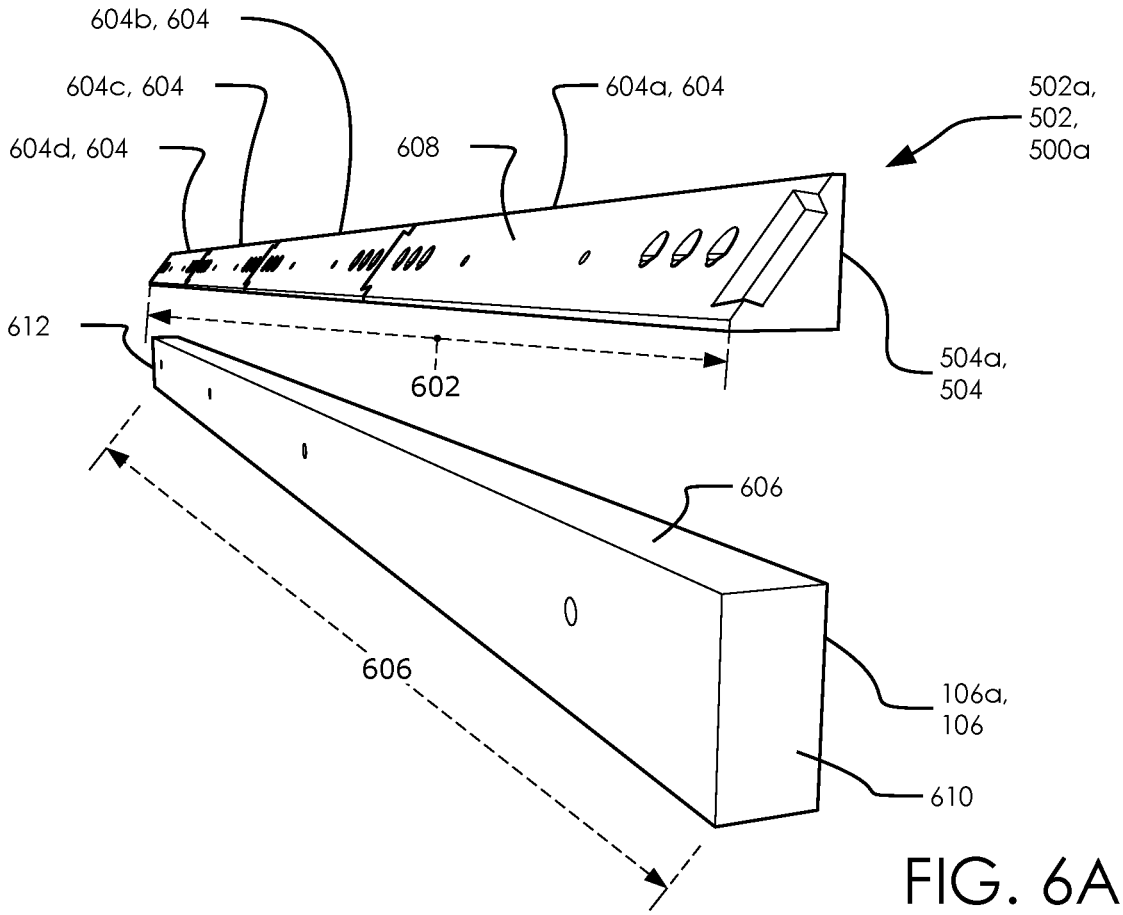
FIG. 6A illustrates a perspective overview view of an exploded view 500*a*.

FIG. 6A illustrates a perspective overview view of an exploded view 500*a*.

Figure 6B:
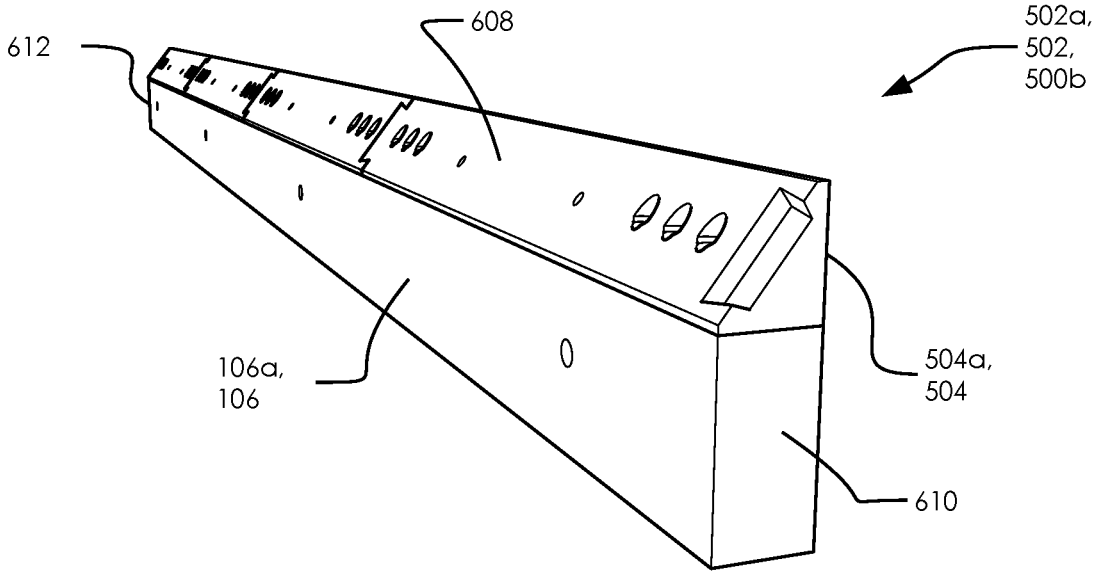
FIG. 6B illustrates a perspective overview view of an assembled view 500*b*.

FIG. 6B illustrates a perspective overview view of an assembled view 500*b*.

In one embodiment, said one or more segments 604 can comprise said first segment 604*a*, said second segment 604*b*, said third segment 604*c* and said fourth segment 604*d*.

In one embodiment, said horizontal rails 106 can comprise said width 606, said first end 610 and said second end 612.

In one embodiment, said safety rail assemblies 502 can comprise said width 602, said width 602, said one or more segments 604 and said beveled face 608.

In one embodiment, said safety rail assemblies 502 can selectively attach to horizontal rails 106 according to the current disclosure. Wherein, said horizontal beveled rails 504 can install beveled face 608 onto horizontal rails 106 for safety and security purposes.

Figure 7A:
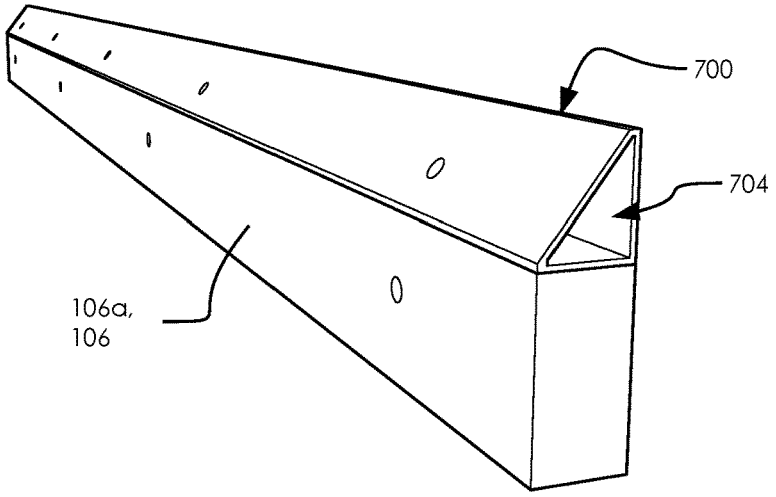
FIG. 7A illustrates a perspective overview view of an extruded rail assembly 700.

FIG. 7A illustrates a perspective overview view of an extruded rail assembly 700.

Figure 7B:
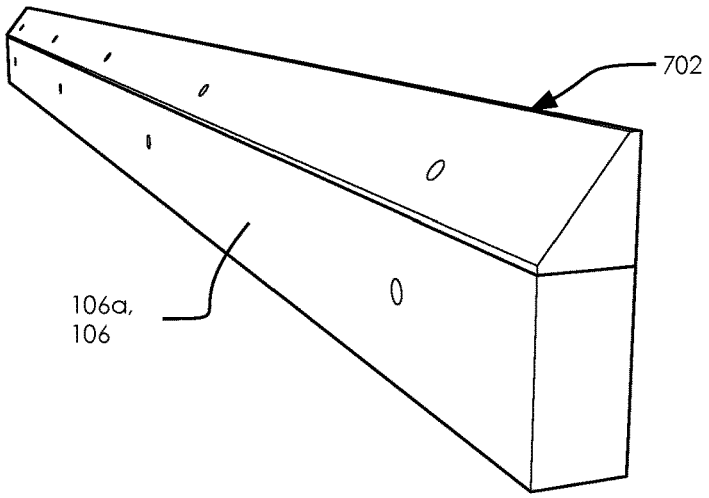
FIG. 7B illustrates a perspective overview view of a wooden rail assembly 702.

FIG. 7B illustrates a perspective overview view of a wooden rail assembly 702.

In one embodiment, said extruded rail assembly 700 can comprise said hollow body 704.

In one embodiment, safety rail assemblies 502 can be constructed of different materials. For example, safety rail assemblies 502 can comprise an injection molded tool, extruded rail assembly 700 can be constructed by extrusion means, and wooden rail assembly 702 can comprise a carved wood embodiment. Each may present different advantages for manufacture and resilience in practice.

Figure 8:
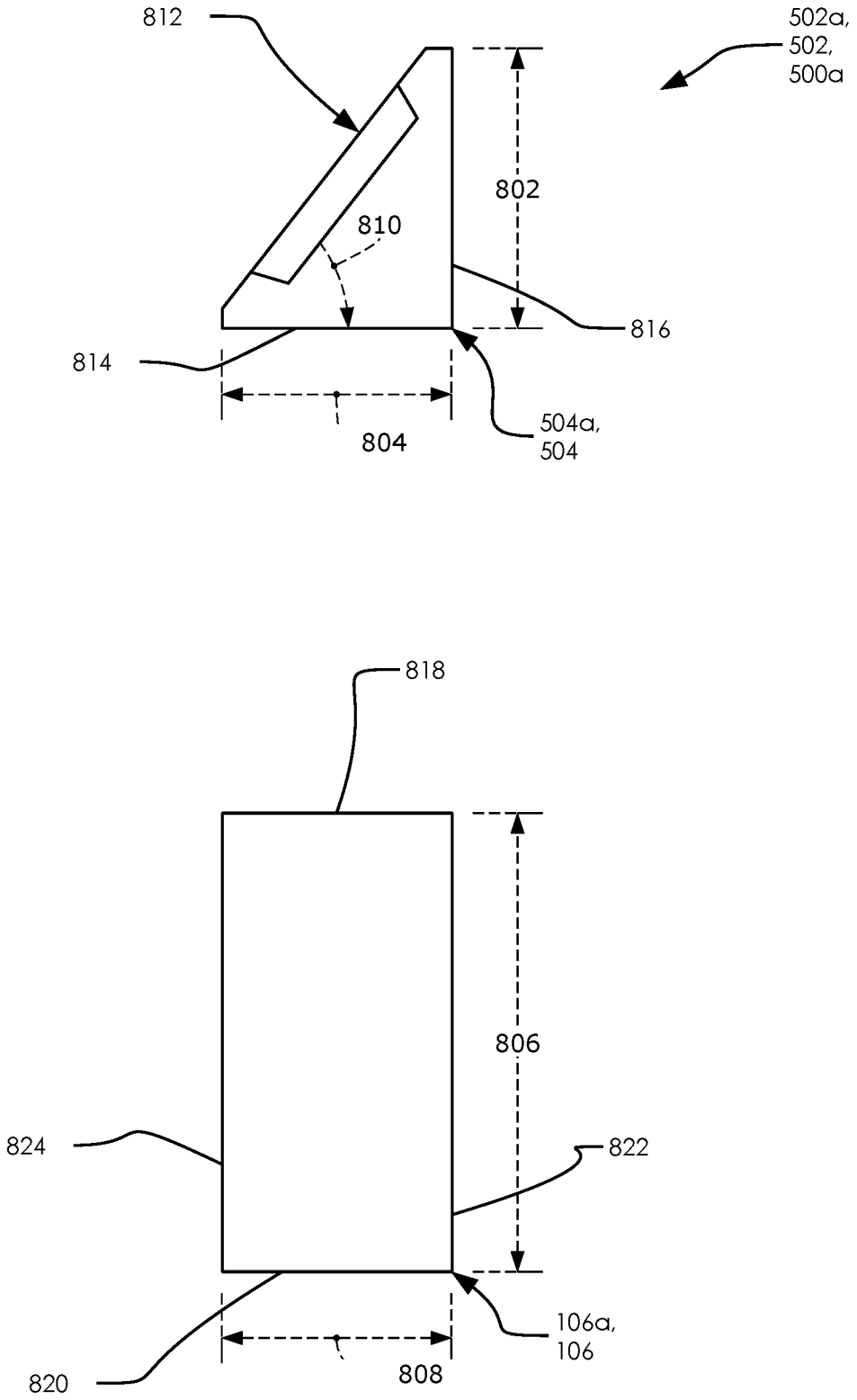
FIG. 8 illustrates an elevated first side view of an exploded view 500*a*.

FIG. 8 illustrates an elevated first side view of an exploded view 500*a*.

In one embodiment, said horizontal rails 106 can comprise said height 806 and said width 808.

In one embodiment, said safety rail assemblies 502 can comprise said height 802 and said width 804.

In one embodiment, said horizontal beveled rails 504 can comprise said bevel angle 810, said beveled face 812, said bottom 814, said back 816, said top 818, said bottom 820, said back 822 and said front 824.

In one embodiment, said bottom 814 can ensure that footing and/or handholds are difficult to gain when attempting to climb said one or more fence segments 100.

Said width 804 can be approximately the same as said width 808, and therefore, said bottom 814 can set down on said top 818 securely.

In one embodiment, said horizontal beveled rails 504 can be secured to said horizontal rails 106 with a nail or fastener. Still yet, said horizontal beveled rails 504 can be secured to said pickets 102, with a nail or fastener.

Said bevel angle 810 can be between 5 degrees and 90 degrees so as to ensure that no lip or top space is easily grasped on said horizontal rails 106.

In one embodiment, said height 806 can be 4" and said width 808 can be 2".

Different scales of said horizontal beveled rails 504 may be employed with a steeper or shallower setting on said bevel angle 810.

In one embodiment, said beveled face 812 can be a substantially planar face designed to be flat across said wooden rail assembly 702. In another embodiment, said beveled face 812 can be concave or convex. In yet another embodiment, said beveled face 812 can comprise an irregular shape and/or surface so as to discourage climbing.

Figure 9A:
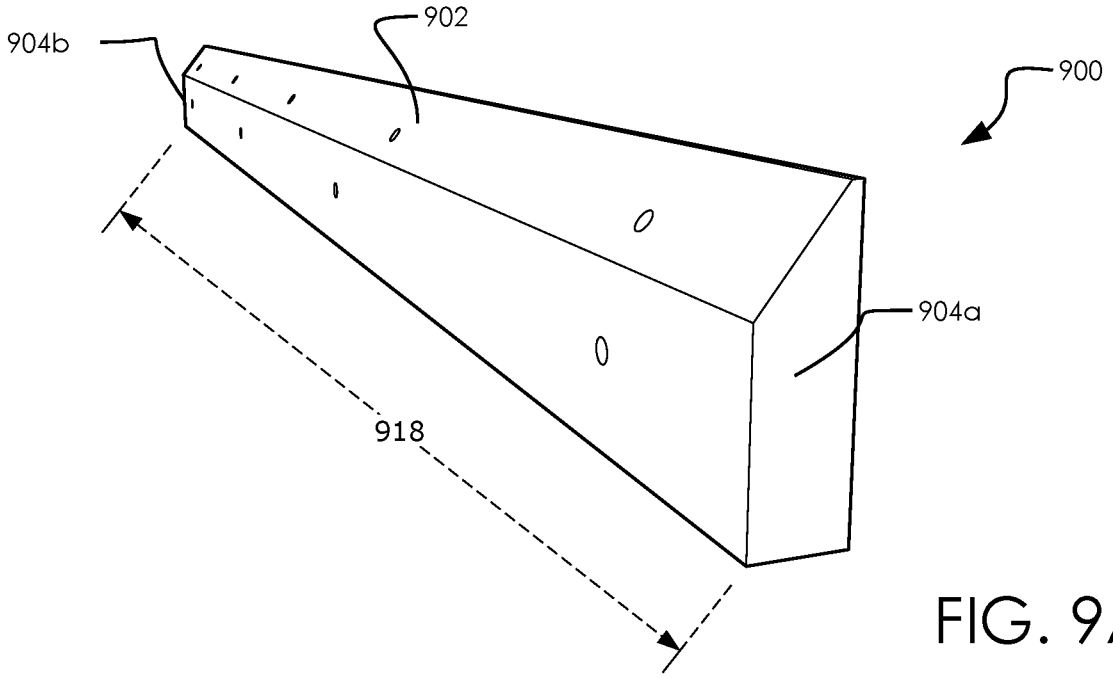
FIG. 9A illustrates a perspective overview view of a first unibody rail assembly 900.

FIG. 9A illustrates a perspective overview view of a first unibody rail assembly 900.

Figure 9B:
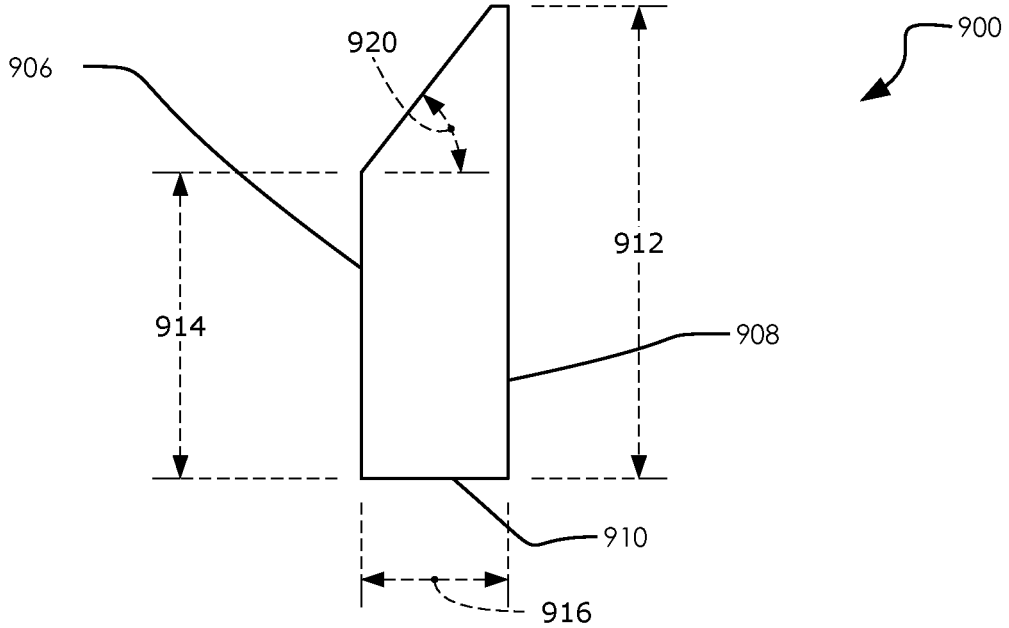
FIG. 9B illustrates an elevated first side view of a first unibody rail assembly 900.

FIG. 9B illustrates an elevated first side view of a first unibody rail assembly 900.

In one embodiment, said first unibody rail assembly 900 can comprise said beveled face 902.

In one embodiment, said first unibody rail assembly 900 and/or said one or more fence segments 100 can comprise manners of replacing the entire old paradigm with a new version of said horizontal rails 106.

Said width 918 can comprise said beveled face 902 at a top portion; wherein, said width 918 is affixed to a portion of said one or more fence segments 100 (such as said pickets 102) with a fastener with said back 908 against said picket spikes 108. Wherein, said beveled face 902 faces outward and up so as to ensure potential trespasser's will have a difficult time climbing said one or more fence segments 100 with said horizontal rails 106 as an aid.

Said lower height 914 can be less than said height 912. Said lower height 914 can span a lower portion of said front 906. As shown, an elevated side view of said width 918 can comprise a trapezoid shape with said beveled face 902 facing out and up. Said width 918 can comprise different shapes provided said back 908 can be secured against said pickets 102, as is known in the art, and said beveled face 902 is facing out and up.

Said beveled face 902 and said bevel angle 920 can comprise similar features and ranges of design as described above for said beveled face 812 and said bevel angle 810.

Figure 10A:
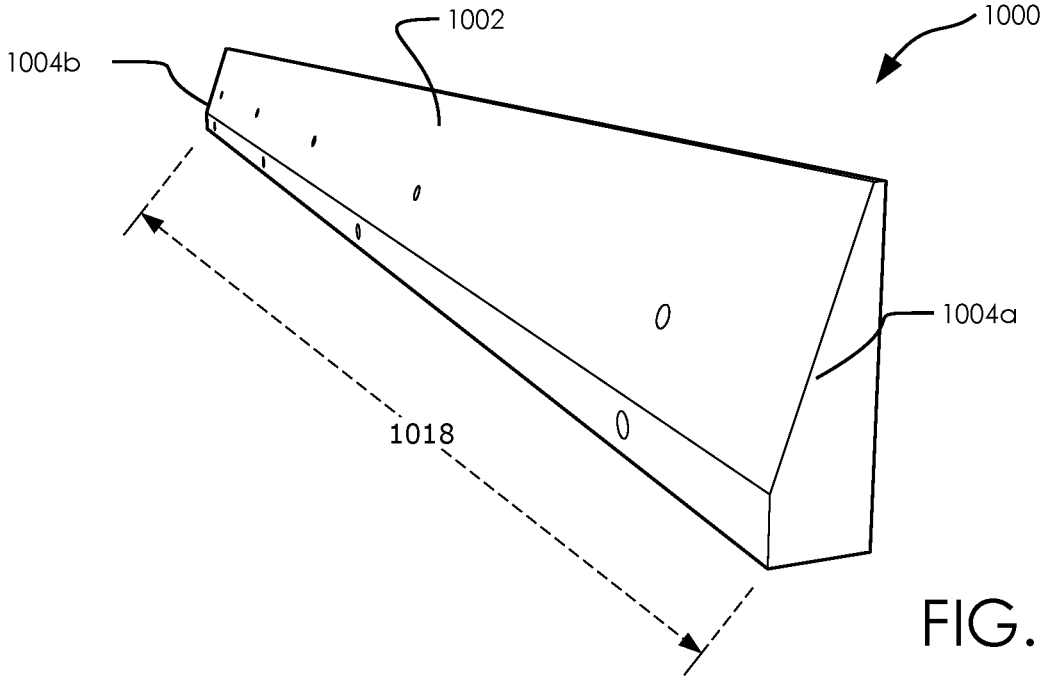
FIG. 10A illustrates a perspective overview view of a second unibody rail assembly 1000.

FIG. 10A illustrates a perspective overview view of a second unibody rail assembly 1000.

Figure 10B:
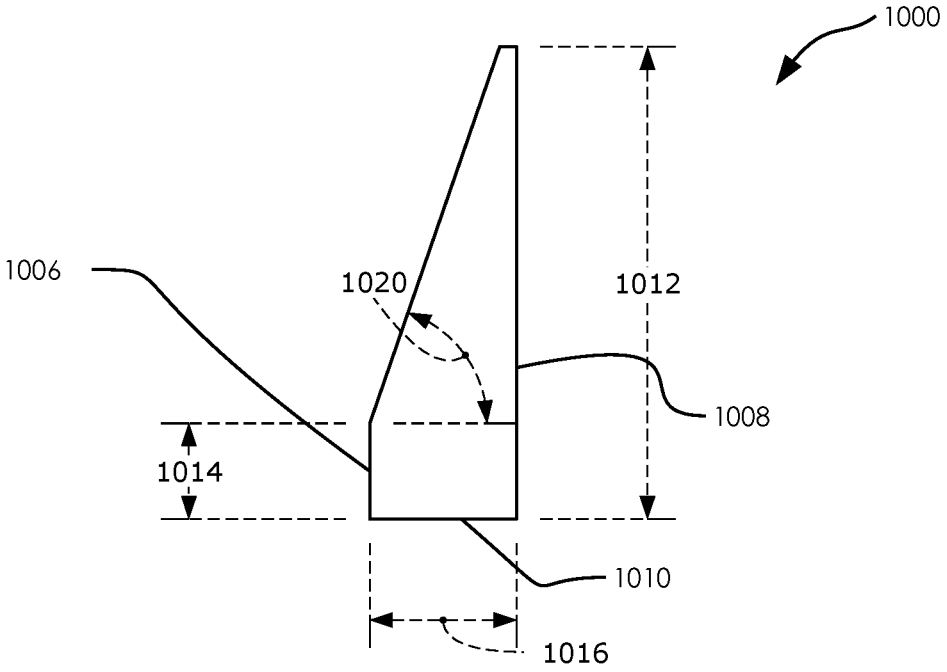
FIG. 10B illustrates an elevated first side view of a second unibody rail assembly 1000.

FIG. 10B illustrates an elevated first side view of a second unibody rail assembly 1000.

In one embodiment, said second unibody rail assembly 1000 can comprise a variation on said width 602. Note, however, that a smaller volume of material is required to fabricate said second unibody rail assembly 1000 than said first unibody rail assembly 900. This is because with said beveled face 1002 being larger than said beveled face 902, said one or more segments 604 can comprise a smaller portion of a blank original piece of lumber, as would be obvious to one in the art. This is on the premise that said height 1012 is similar to said height 912 and said depth 1016 is similar to said depth 916.

Otherwise, said one or more segments 604 can have similar properties to said width 602, as discussed above.

Figure 11:
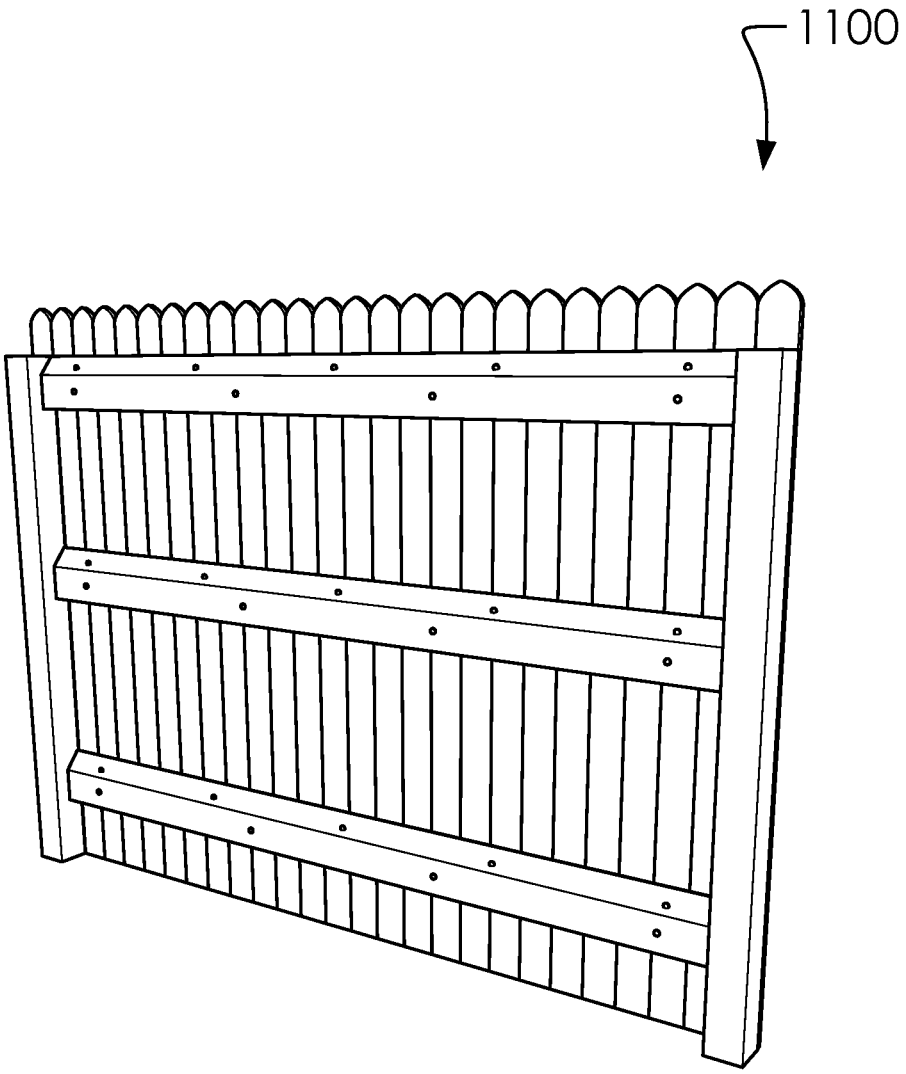
FIG. 11 illustrates a perspective overview view of an improved fence segment 1100.

FIG. 11 illustrates a perspective overview view of an improved fence segment 1100.

Said improved fence segment 1100 can comprise said one or more fence segments 100 with said horizontal beveled rails 504 installed on said horizontal rails 106.

As discussed above, said improved fence segment 1100 would be difficult to scale and overcome due to the presence of said beveled face 812.

Similarly, said improved fence segment 1100 could be illustrated with said width 602 and/or said one or more segments 604 with a similar outcome in functionality.

In one embodiment, said horizontal beveled rails 504, said width 602 and/or said one or more segments 604 can comprise a wood material, a plastic injection molded material, a steel, an aluminum, a composite material, or similar. One advantage to using an injection molded material can comprise a minimal manufacturing cost. With said composite material, the presence of said horizontal rails 106 under said horizontal beveled rails 504 can endure that said horizontal beveled rails 504 do not droop or deform in heat.

FIG. 12 illustrates a perspective overview view of an alternative fence configuration 1200.

Said alternative fence configuration 1200 can comprise a different configuration of said third horizontal rail 106*c*, being rotated 90 degrees about a center axis and extending from center point to center point of said posts 104. This configuration may require only said first horizontal beveled rail 504*a* and said second horizontal beveled rail 504*b* for said first horizontal rail 106*a* and said second horizontal rail 106*b*. Other obvious changes to the use and configuration of said horizontal beveled rails 504 and/or one or more horizontal beveled rails width 602 one or more segments 604 would be clear to one in the field.

Figure 13A:
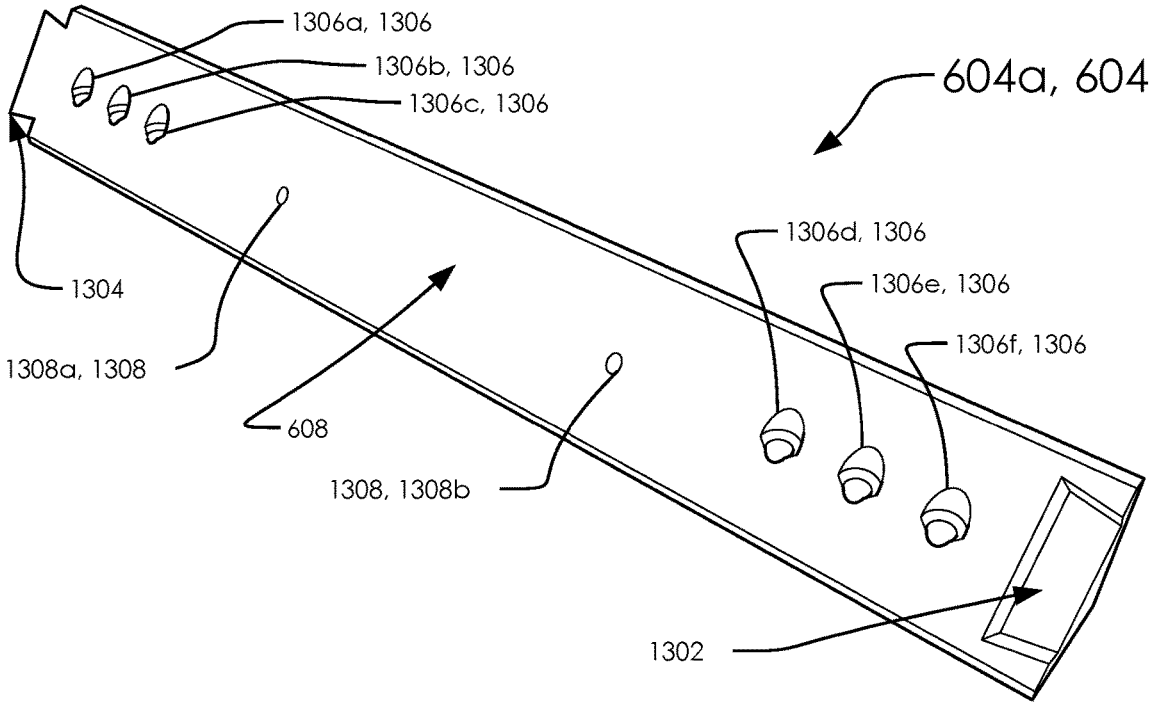
FIG. 13A illustrates a perspective overview view of a first segment 604*a*.

FIG. 13A illustrates a perspective overview view of a first segment 604*a*.

Figure 13B:
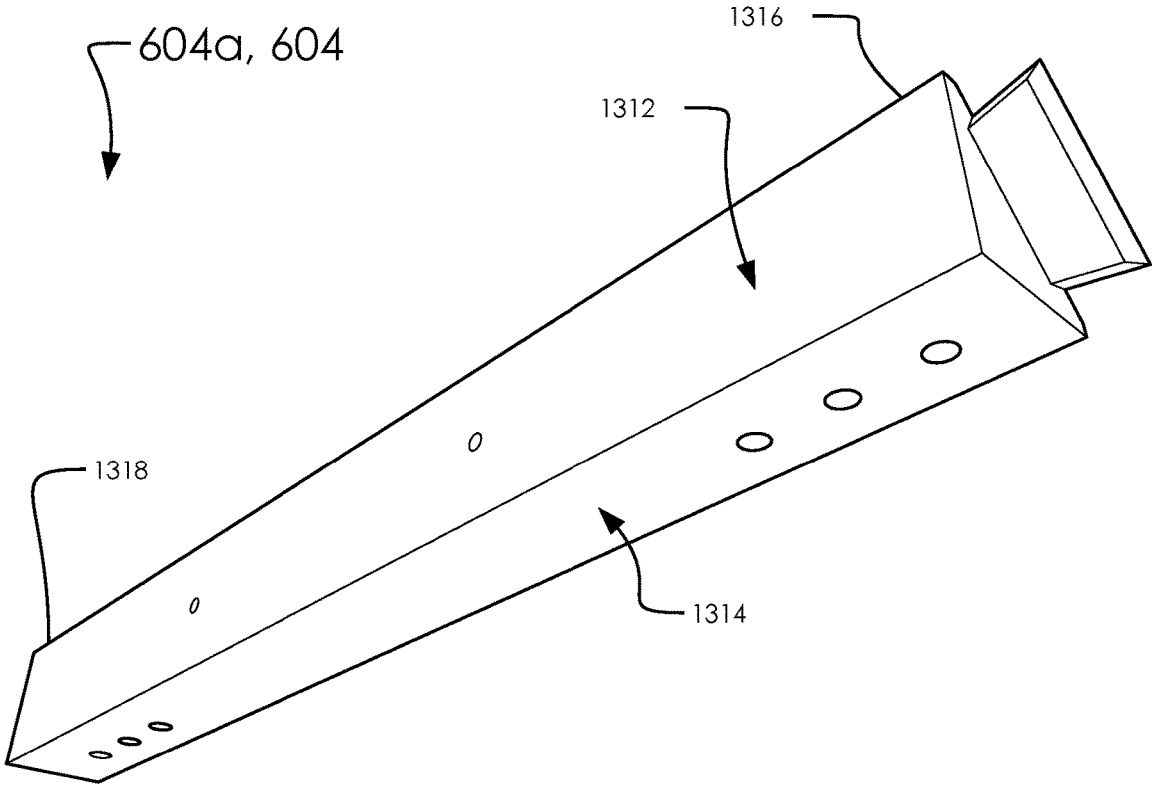
FIG. 13B illustrates a perspective back side view of a first segment 604*a*.

FIG. 13B illustrates a perspective back side view of a first segment 604*a*.

In one embodiment, said one or more vertical apertures 1306 can comprise said first vertical aperture 1306*a*, said second vertical aperture 1306*b*, said third vertical aperture 1306*c*, said fourth vertical aperture 1306*d*, said fifth vertical aperture 1306*e* and said sixth vertical aperture 1306*f*.

In one embodiment, said one or more horizontal apertures 1308 can comprise said first horizontal aperture 1308*a* and said second horizontal aperture 1308*b*.

In one embodiment, said safety rail assemblies 502 can comprise said second end 1318.

In one embodiment, said first segment 604*a* can comprise said slot 1302, said tab 1304, said tab 1304, said one or more vertical apertures 1306, said sixth vertical aperture 1306*f* and said one or more horizontal apertures 1308.

In one embodiment, said beveled face 608 can comprise said back side 1312, said bottom side 1314, said first end 1316 and said second end 1318.

In one embodiment, each among one or more segments 604 can break apart into substantially identical parts, such as first segment 604*a*.

one or more segments 604 can each comprise slot 1302 at second end 1318, tab 1304 at back side 1312, one or more horizontal apertures 1308 from beveled face 608 to back side 1312, and one or more vertical apertures 1306 from beveled face 608 to bottom side 1314.

In one embodiment, said slot 1302 can be configured to selectively mate with tab 1304 when attaching two among said one or more segments 604 to one another.

In one embodiment, attaching one or more segments 604 to one or more fence segments 100 can comprise aligning a portion of said bottom side 1314 of one or more segments 604 with horizontal rails 106 and a portion of back side 1312 of one or more segments 604 with a portion of pickets 102, attaching one or more segments 604 to horizontal rails 106 and pickets 102, and attaching one or more among said horizontal beveled rails 504 to one another with said slot 1302 and tab 1304.

Figure 14A:
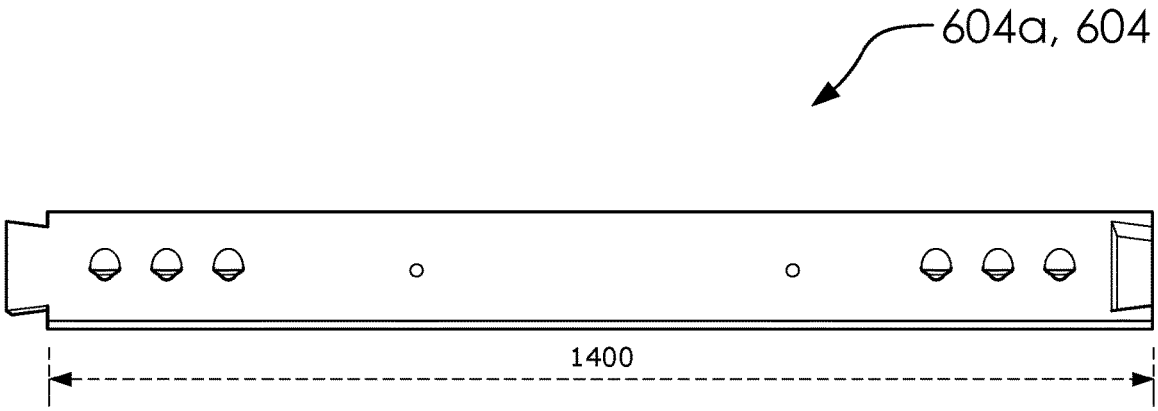
FIG. 14A illustrates an elevated top side view of a one or more segments 604.

FIG. 14A illustrates an elevated top side view of a one or more segments 604.

Figure 14B:
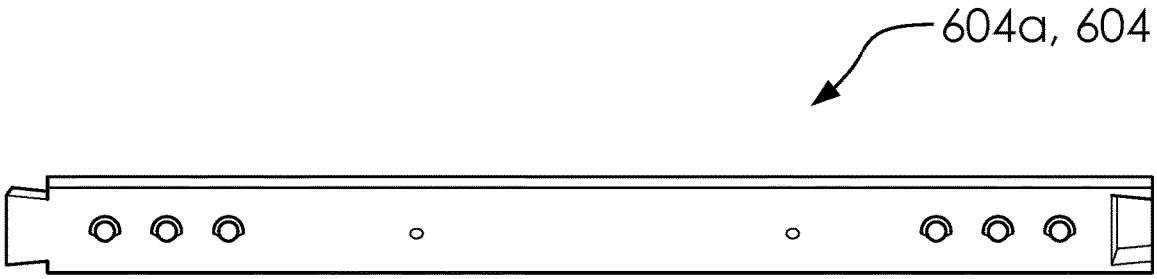
FIG. 14B illustrates an elevated front side view of a one or more segments 604.

FIG. 14B illustrates an elevated front side view of a one or more segments 604.

Figure 14C:
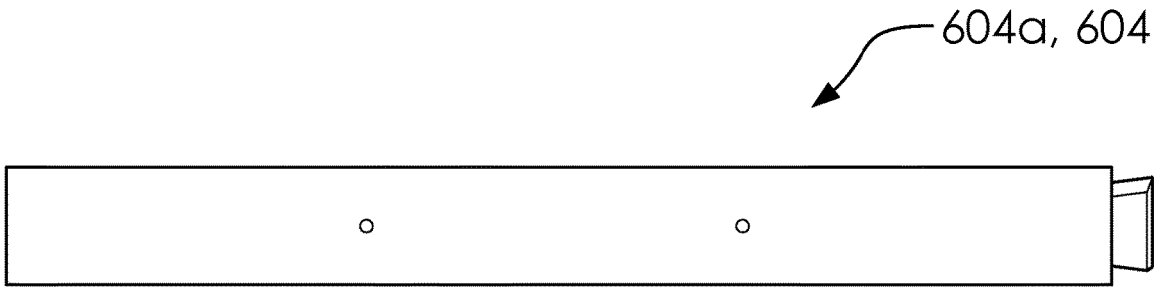
FIG. 14C illustrates an elevated back side view of a one or more segments 604.

FIG. 14C illustrates an elevated back side view of a one or more segments 604.

In one embodiment, said safety rail assemblies 502 can comprise said width 1400.

In one embodiment, width 1400 can comprise two feet. Accordingly, using four of one or more segments 604 can result in an eight foot length, which can be a standard length for safety rail assemblies 502.

In one embodiment, a portion of one or more of one or more segments 604 can be cut off to fit span 112 as necessary.

Figure 15A:
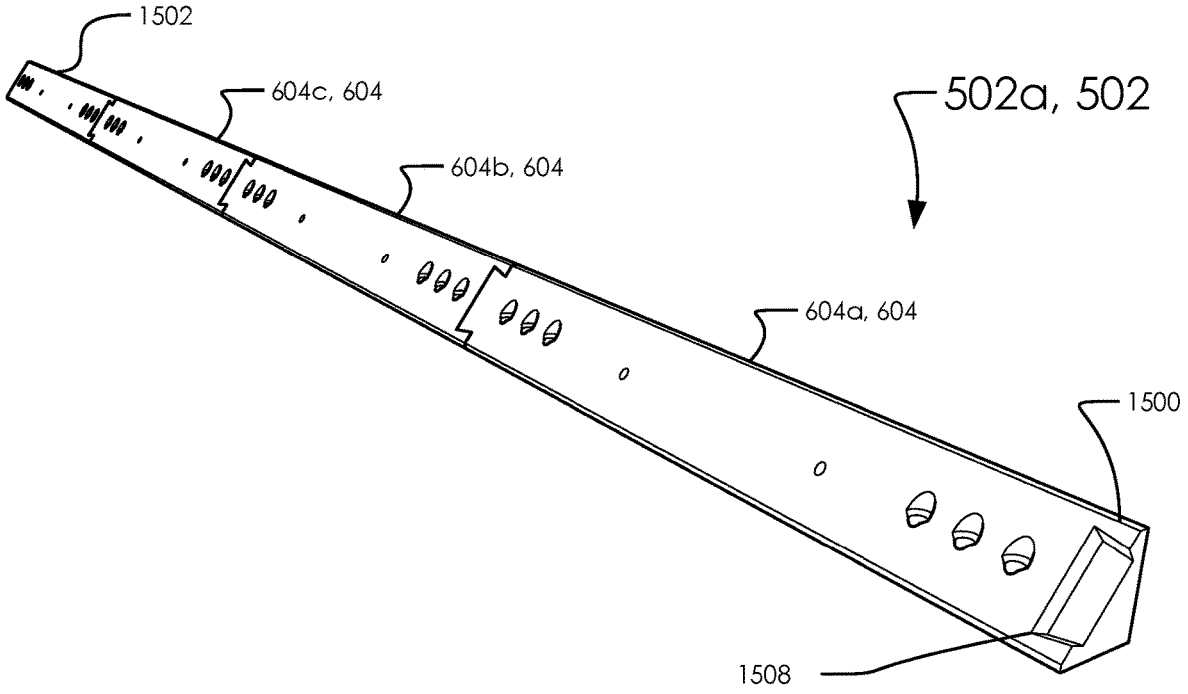
FIG. 15A illustrates a perspective overview view of a safety rail assemblies 502.

FIG. 15A illustrates a perspective overview view of a safety rail assemblies 502.

Figure 15B:
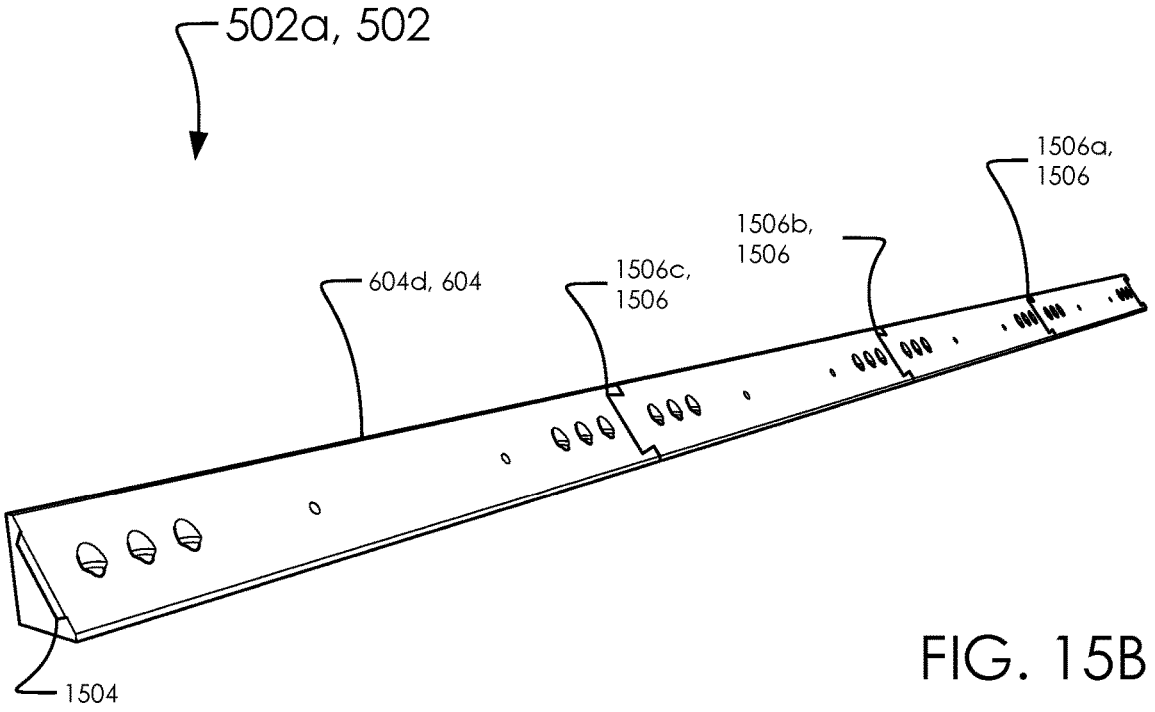
FIG. 15B illustrates a perspective second side view of a safety rail assemblies 502.

FIG. 15B illustrates a perspective second side view of a safety rail assemblies 502.

In one embodiment, said one or more joints 1506 can comprise said first joint 1506*a*, said second joint 1506*b* and said third joint 1506*c*.

In one embodiment, said safety rail assemblies 502 can comprise said first end 1500, said second end 1502, said cut off tab 1504, said cut off tab 1504, said one or more joints 1506 and said empty slot 1508.

In one embodiment, with two or more among said one or more segments 604 attached to one another, said one or more joints 1506 represent the points at which slot 1302 of one segment attaches to tab 1304 of another segment. For example, with first segment 604*a* through fourth segment 604*d* in use, as illustrated, first segment 604*a* and second segment 604*b* share first joint 1506*a*; second segment 604*b* and third segment 604*c* share second joint 1506*b*, and third segment 604*c* and fourth segment 604*d* share third joint 1506*c*.

In one embodiment, there will be one tab 1304 and one slot 1302 that are not used as one or more segments 604 forms a substantially straight member when assembled. Accordingly, empty slot 1508 and cut off tab 1504 must be considered. In one embodiment, cut off tab 1504 can comprise a tab 1304 having been cut off in order to eliminate extra material at the end of safety rail assemblies 502.

Figure 16A:
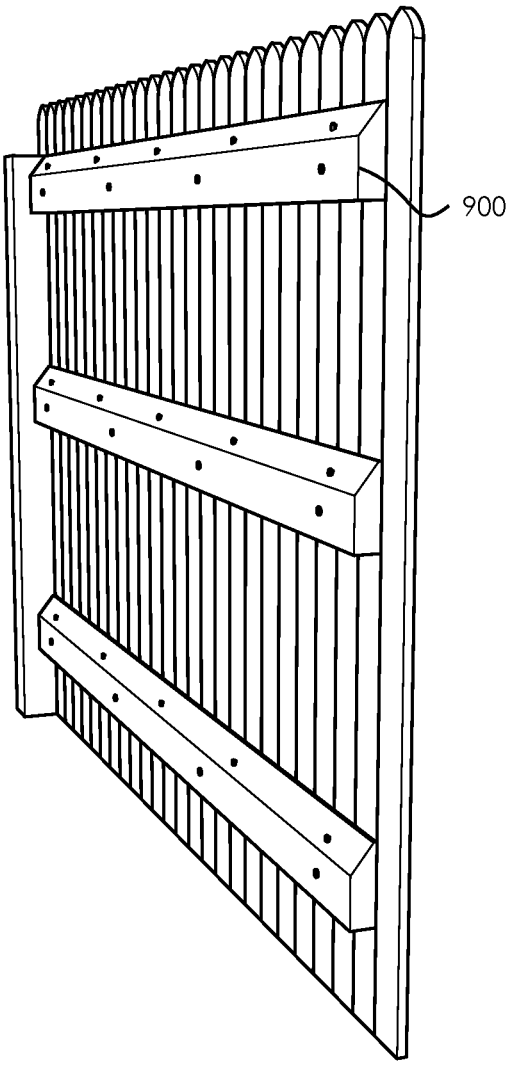
FIG. 16A illustrates a perspective overview view of a first unibody rail assembly 900.

FIG. 16A illustrates a perspective overview view of a first unibody rail assembly 900.

Figure 16B:
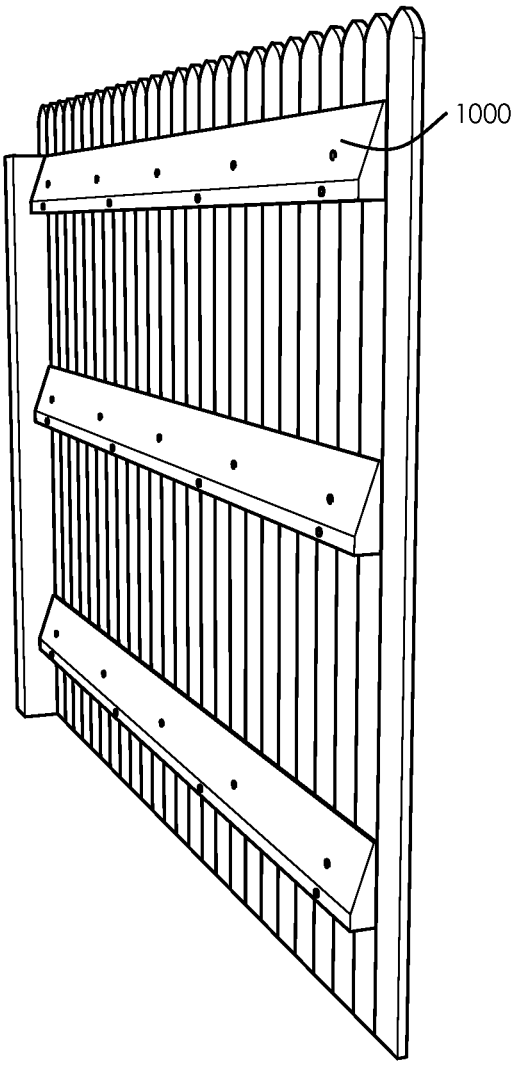
FIG. 16B illustrates a perspective overview view of a second unibody rail assembly 1000.

FIG. 16B illustrates a perspective overview view of a second unibody rail assembly 1000.

first unibody rail assembly 900 and second unibody rail assembly 1000, as illustrated, are included for completeness of disclosure The following sentences are included for completeness of this disclosure with reference to the claims.

A safety rail assemblies 502 for improving a one or more fence segments 100. Said safety rail assemblies 502 comprising a beveled face 608, a width 804, a height 802, a bottom 814, a back 816, a bevel angle 810. Said safety rail assemblies 502 configured to selectively attach to a horizontal rails 106 and a pickets 102 of said one or more fence segments 100. Said bottom 814 of said safety rail assemblies 502 attaches to a top 818 of said horizontal rails 106. Said back 816 of a horizontal beveled rails 504 attaches to said pickets 102. Said bottom 814 is a horizontal plane. Said back 816 is a vertical plane. A beveled face 812 comprises said bevel angle 810 and represents a face of said horizontal beveled rails 504 being non-horizontal and non-vertical between said back 816 and said bottom 814.

Said safety rail assemblies 502 is attached to said pickets 102 with said beveled face 812 facing upward to prevent easy climbing of said one or more fence segments 100.

Said safety rail assemblies 502 comprise an unibody construction comprising a portion of said horizontal rails 106 with said beveled face 812 carved into a rectangular body. Said safety rail assemblies 502 is attached to said pickets 102 with said beveled face 812 facing upward to prevent easy climbing of said one or more fence segments 100.

Said safety rail assemblies 502 is constructed from carved wood.

Said safety rail assemblies 502 is constructed by extrusion means. Said safety rail assemblies 502 comprises a hollow body 704 being constructed in a manner used for PVC pipe.

Said safety rail assemblies 502 comprises an injection molded body.

Said safety rail assemblies 502 comprise a one or more segments 604. Each among said one or more segments 604 are configured to selectively break apart into separate and similar parts.

Said one or more segments 604 comprise at least a first segment 604*a* and a second segment 604*b*. Said one or more segments 604 can each comprise a slot 1302 at a second end 1318, a tab 1304 at a back side 1312, a one or more horizontal apertures 1308 from said beveled face 608 to said back side 1312, and a one or more vertical apertures 1306 from said beveled face 608 to a bottom side 1314. Said slot

1302 of said first segment 604*a* selectively mates with said tab 1304 of said second segment 604*b*.

Attaching said one or more segments 604 to said one or more fence segments 100 comprise aligning a portion of a bottom side 1314 of said one or more segments 604 with said horizontal rails 106 and a portion of a back side 1312 of said one or more segments 604 with a portion of said pickets 102, attaching said one or more segments 604 to said horizontal rails 106 and said pickets 102, and attaching one or more among said horizontal beveled rails 504 to one another with a slot 1302 and a tab 1304.

Said safety rail assemblies 502 comprise a one or more segments 604. Each among said one or more segments 604 are configured to selectively break apart into separate and similar parts. Said one or more segments 604 comprise at least a first segment 604*a* and a second segment 604*b*. Said one or more segments 604 can each comprise a slot 1302 at a second end 1318, a tab 1304 at a back side 1312, a one or more horizontal apertures 1308 from said beveled face 608 to said back side 1312, and a one or more vertical apertures 1306 from said beveled face 608 to a bottom side 1314. Said slot 1302 of said first segment 604*a* selectively mates with said tab 1304 of said second segment 604*b*. Attaching said one or more segments 604 to said one or more fence segments 100 comprise aligning a portion of said bottom side 1314 of said one or more segments 604 with said horizontal rails 106 and a portion of said back side 1312 of said one or more segments 604 with a portion of said pickets 102, attaching said one or more segments 604 to said horizontal rails 106 and said pickets 102, and attaching one or more among said horizontal beveled rails 504 to one another with said slot 1302 and said tab 1304. A safety rail assemblies 502 for improving a one or more fence segments 100.

Said safety rail assemblies 502 comprising a beveled face 608, a width 804, a height 802, a bottom 814, a back 816, a bevel angle 810. Said safety rail assemblies 502 configured to selectively attach to a horizontal rails 106 and a pickets 102 of said one or more fence segments 100. Said bottom 814 of said safety rail assemblies 502 attaches to a top 818 of said horizontal rails 106. Said back 816 of a horizontal beveled rails 504 attaches to said pickets 102. Said bottom 814 is a horizontal plane. Said back 816 is a vertical plane. A beveled face 812 comprises said bevel angle 810 and represents a face of said horizontal beveled rails 504 being non-horizontal and non-vertical between said back 816 and said bottom 814. Said safety rail assemblies 502 is attached to said pickets 102 with said beveled face 812 facing upward to prevent easy climbing of said one or more fence segments 100. Said safety rail assemblies 502 comprise a one or more segments 604. Each among said one or more segments 604 are configured to selectively break apart into separate and similar parts. Said one or more segments 604 comprise at least a first segment 604*a* and a second segment 604*b*. Said one or more segments 604 can each comprise a slot 1302 at a second end 1318, a tab 1304 at a back side 1312, a one or more horizontal apertures 1308 from said beveled face 608 to said back side 1312, and a one or more vertical apertures 1306 from said beveled face 608 to a bottom side 1314. Said slot 1302 of said first segment 604*a* selectively mates with said tab 1304 of said second segment 604*b*. Attaching said one or more segments 604 to said one or more fence segments 100 comprise aligning a portion of said bottom side 1314 of said one or more segments 604 with said horizontal rails 106 and a portion of said back side 1312 of said one or more segments 604 with a portion of said pickets 102, attaching said one or more segments 604 to said horizontal rails 106 and said pickets 102, and attaching one or more among said horizontal beveled rails 504 to one another with said slot 1302 and said tab 1304.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. Safety rail assemblies for improving one or more fence segments, wherein:

said safety rail assemblies comprising at least one horizontal beveled rail having a beveled face, a width, a height, a bottom, a back, and a bevel angle;

said safety rail assemblies configured to selectively attach to horizontal rails and pickets of said one or more fence segments;

said bottom of said safety rail assemblies attaches to a top of said horizontal rails;

said back of said at least one horizontal beveled rail attaches to said pickets;

said bottom is a horizontal plane;

said back is a vertical plane;

said beveled face comprises said bevel angle and represents a face of said at least one horizontal beveled rail being non-horizontal and non-vertical between said back and said bottom;

said safety rail assemblies comprise one or more segments;

each among said one or more segments are configured to selectively break apart into separate and similar parts;

wherein:

said one or more segments comprise at least a first segment and a second segment;

said one or more segments each comprise a slot at a second end, a tab at a back side, one or more horizontal apertures from said beveled face to said back side, and one or more vertical apertures from said beveled face to a bottom side; and said slot of said first segment selectively mates with said tab of said second segment.

2. The safety rail assemblies from claim 1, wherein:

said safety rail assemblies are attached to said pickets with said beveled face facing upward to inhibit climbing of said one or more fence segments.

3. The safety rail assemblies from claim 1, wherein:

said safety rail assemblies comprise a unibody construction comprising a portion of said horizontal rails with said beveled face carved into a rectangular body; and said safety rail assemblies are attached to said pickets with said beveled face facing upward to inhibit climbing of said one or more fence segments.

4. The safety rail assemblies from claim 1, wherein:

said safety rail assemblies are constructed from carved wood.

5. The safety rail assemblies from claim 1, wherein:

said safety rail assemblies are constructed by extrusion means; and said safety rail assemblies comprises a hollow body.

6. The safety rail assemblies from claim 1, wherein:

said safety rail assemblies comprise an injection molded body.

7. The safety rail assemblies from claim 1, wherein:

attaching said one or more segments to said one or more fence segments comprises aligning a portion of a bottom side of said one or more segments with said horizontal rails and a portion of a back side of said one or more segments with a portion of said pickets, attaching said one or more segments to said horizontal rails and said pickets, and attaching one or more among said one or more segments to one another with a said slot and said a tab.

8. Safety rail assemblies for improving one or more fence segments, wherein:

said safety rail assemblies comprising at least one horizontal beveled rail having a beveled face, a width, a height, a bottom, a back, and a bevel angle;

said safety rail assemblies configured to selectively attach to horizontal rails and pickets of said one or more fence segments;

said bottom of said safety rail assemblies attaches to a top of said horizontal rails;

said back of said at least one horizontal beveled rail attaches to said pickets;

said bottom is a horizontal plane;

said back is a vertical plane;

said beveled face comprises said bevel angle and represents a face of said at least one horizontal beveled rail being non-horizontal and non-vertical between said back and said bottom;

said safety rail assemblies are attached to said pickets with said beveled face facing upward to inhibit climbing of said one or more fence segments;

said safety rail assemblies comprise one or more segments;

each among said one or more segments are configured to selectively break apart into separate and similar parts;

said one or more segments comprise at least a first segment and a second segment;

said one or more segments each comprise a slot at a second end, a tab at a back side, one or more horizontal apertures from said beveled face to said back side, and one or more vertical apertures from said beveled face to a bottom side;

said slot of said first segment selectively mates with said tab of said second segment; and attaching said one or more segments to said one or more fence segments comprises aligning a portion of said bottom side of said one or more segments with said horizontal rails and a portion of said back side of said one or more segments with a portion of said pickets, attaching said one or more segments to said horizontal rails and said pickets, and attaching one or more among said one or more segments to one another with said slot and said tab.

* * * * *